US007942758B2

(12) United States Patent
Nakamura

(10) Patent No.: US 7,942,758 B2
(45) Date of Patent: May 17, 2011

(54) HEAD FOR GOLF PUTTER AND GOLF PUTTER

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 16 days.

(21) Appl. No.: 12/285,457

(22) Filed: Oct. 6, 2008

(65) Prior Publication Data

US 2009/0149271 A1 Jun. 11, 2009

(30) Foreign Application Priority Data

Dec. 7, 2007 (JP) ..... 2007-316600

(51) Int. Cl.
*A63B 53/04* (2006.01)

(52) U.S. Cl. ..... 473/340; 473/342

(58) Field of Classification Search ..... 473/324–350
See application file for complete search history.

(56) References Cited

U.S. PATENT DOCUMENTS

| | | | | |
|---|---|---|---|---|
| 4,681,322 | A * | 7/1987 | Straza et al. | 473/329 |
| 4,749,197 | A * | 6/1988 | Orlowski | 473/342 |
| 5,090,702 | A * | 2/1992 | Viste | 473/331 |
| 5,221,087 | A * | 6/1993 | Fenton et al. | 473/342 |
| 5,282,624 | A * | 2/1994 | Viste | 473/342 |
| 5,485,997 | A | 1/1996 | Schmidt et al. | |
| 5,766,092 | A * | 6/1998 | Mimeur et al. | 473/329 |
| 5,766,094 | A * | 6/1998 | Mahaffey et al. | 473/342 |
| 5,944,619 | A * | 8/1999 | Cameron | 473/332 |
| 6,001,030 | A * | 12/1999 | Delaney | 473/329 |
| 6,203,449 | B1 * | 3/2001 | Kenmi | 473/346 |
| 6,273,827 | B1 * | 8/2001 | Hockerson et al. | 473/236 |
| 6,299,548 | B1 * | 10/2001 | Lin | 473/331 |
| 6,302,807 | B1 * | 10/2001 | Rohrer | 473/329 |
| 6,322,459 | B1 * | 11/2001 | Nishimura et al. | 473/330 |
| 6,334,818 | B1 * | 1/2002 | Cameron et al. | 473/332 |
| 6,431,997 | B1 * | 8/2002 | Rohrer | 473/324 |
| 6,824,475 | B2 * | 11/2004 | Burnett et al. | 473/329 |
| 7,018,303 | B2 * | 3/2006 | Yamamoto | 473/329 |
| 7,048,648 | B2 * | 5/2006 | Breier et al. | 473/340 |
| 7,066,833 | B2 * | 6/2006 | Yamamoto | 473/330 |
| 7,169,062 | B2 * | 1/2007 | Chen | 473/342 |
| 7,273,420 | B2 * | 9/2007 | Wright | 473/329 |
| 7,278,926 | B2 * | 10/2007 | Frame | 473/329 |

(Continued)

FOREIGN PATENT DOCUMENTS

| | | | |
|---|---|---|---|
| JP | 04212387 A | * | 8/1992 |
| JP | 8-196668 A | | 8/1996 |
| JP | 11333031 A | * | 12/1999 |
| JP | 2001054599 A | * | 2/2001 |

(Continued)

*Primary Examiner* — Alvin A Hunter
(74) *Attorney, Agent, or Firm* — Birch, Stewart, Kolasch & Birch, LLP

(57) ABSTRACT

A golf putter (2) includes a head (4), a grip (6) and a shaft (8). The head (4) has a head body (h1) formed of a metal and a face member (f1) formed by an elastic material. A front surface (Ff) of the face member (f1) constitutes at least a part of a face surface (10). A siping (s1) is provided on a back surface (Bf) of the face member (f1). The siping (s1) is not provided on the front surface (Ff) of the face member (f1). It is preferable that the siping (s1) should be extended with bending. It is preferable that a ratio (Ds/Tf) of a depth (Ds) of the siping (s1) to a thickness (Tf) of the face member (f1) should be equal to or higher than 0.2 and should be equal to or lower than 0.8. It is preferable that a width (Ws) of the siping (s1) should be equal to or smaller than 1.0 mm.

6 Claims, 7 Drawing Sheets

U.S. PATENT DOCUMENTS

| | | | | |
|---|---|---|---|---|
| 7,364,513 | B2 * | 4/2008 | Krumme | 473/329 |
| 7,431,662 | B2 * | 10/2008 | Tucker et al. | 473/288 |
| 7,465,240 | B2 * | 12/2008 | Frame | 473/329 |
| 7,500,923 | B2 * | 3/2009 | Tateno | 473/329 |
| 7,578,755 | B2 * | 8/2009 | Oyama | 473/342 |
| 2005/0090328 | A1 | 4/2005 | Sano | |

FOREIGN PATENT DOCUMENTS

| | | | | |
|---|---|---|---|---|
| JP | 2001170227 | A | * | 6/2001 |
| JP | 2002126135 | A | * | 5/2002 |
| JP | 2002253709 | A | * | 9/2002 |
| JP | 2004-236985 | A | | 8/2004 |
| JP | 2005-124730 | A | | 5/2005 |

* cited by examiner

HEAD FOR GOLF PUTTER AND GOLF PUTTER

This application claims priority on Patent Application No. 2007-316600 filed in JAPAN on Dec. 7, 2007, the entire contents of which are hereby incorporated by reference.

BACKGROUND OF THE INVENTION

1. Field of the Invention

The present invention relates to a head for a golf putter and the golf putter.

2. Description of the Related Art

As a golf putter, there have been known a first type which is formed of a metal including a face surface and a second type in which a face insert is disposed on a metallic head body.

In the second type, the face insert is formed by an elastic material. The second type is advantageous to a golf player who desires a feeling of soft hitting. In the case in which a hard golf ball is used, particularly, the second type has an advantage that a rolling distance and a direction can easily be controlled. Japanese Laid-Open Patent Publications Nos. 8-196668 and 2005-124730 have disclosed the golf putter of the second type. Moreover, Japanese Laid-Open Patent Publication No. 2004-236985 has disclosed a face insert having a multilayer structure. U.S. Pat. No. 5,485,997 corresponds to the Japanese Laid-Open Patent Publication No. 8-196668. US Patent Application No. US2005/0090328 A1 corresponds to the Japanese Laid-Open Patent Publication No. 2005-124730.

SUMMARY OF THE INVENTION

By softening a material of a face insert, it is possible to achieve a feeling of softer hitting. In the case in which the material of the face insert is excessively soft, however, a resilience of a ball is stabilized with difficulty. More specifically, in the case in which the material of the face insert is excessively soft, an amount of elastic deformation of the face insert in an impact is large. Therefore, there might be caused a phenomenon in which the resilience of the ball is excessively increased or is reduced. For this reason, it is hard to control a rolling distance. In the case in which the material of the face insert is excessively soft, moreover, the face insert is excessively deformed so that a hitting directivity might be reduced. The excessively soft face insert might deteriorate a hitting control property.

It is an object of the present invention to provide a head for a golf putter and the golf putter which can achieve a consistency of a hitting control property with a feeling of soft hitting.

A head for a golf putter according to the present invention includes a head body formed of a metal and a face member formed by an elastic material. A front surface of the face member constitutes at least a part of a face surface. A siping is provided on a back surface of the face member. The siping is not provided on the front surface of the face member.

It is preferable that the siping should be extended with bending.

It is preferable that a ratio (Ds/Tf) of a depth Ds of the siping to a thickness Tf of the face member should be equal to or higher than 0.2 and be equal to or lower than 0.8.

It is preferable that a width Ws of the siping should be equal to or smaller than 1.0 mm.

A golf putter according to the present invention includes a head for a golf putter, a shaft and a grip. The head has a head body formed of a metal and a face member formed by an elastic material. A front surface of the face member constitutes at least a part of a face surface. A back surface of the face member is provided with a siping. The front surface of the face member is not provided with the siping.

By providing the siping on the back surface of the face member, it is possible to achieve a consistency of a hitting control property with a feeling of soft hitting.

DESCRIPTION OF THE PREFERRED EMBODIMENTS

The present invention will be described below in detail based on a preferred embodiment with reference to the drawings.

Figure 1:
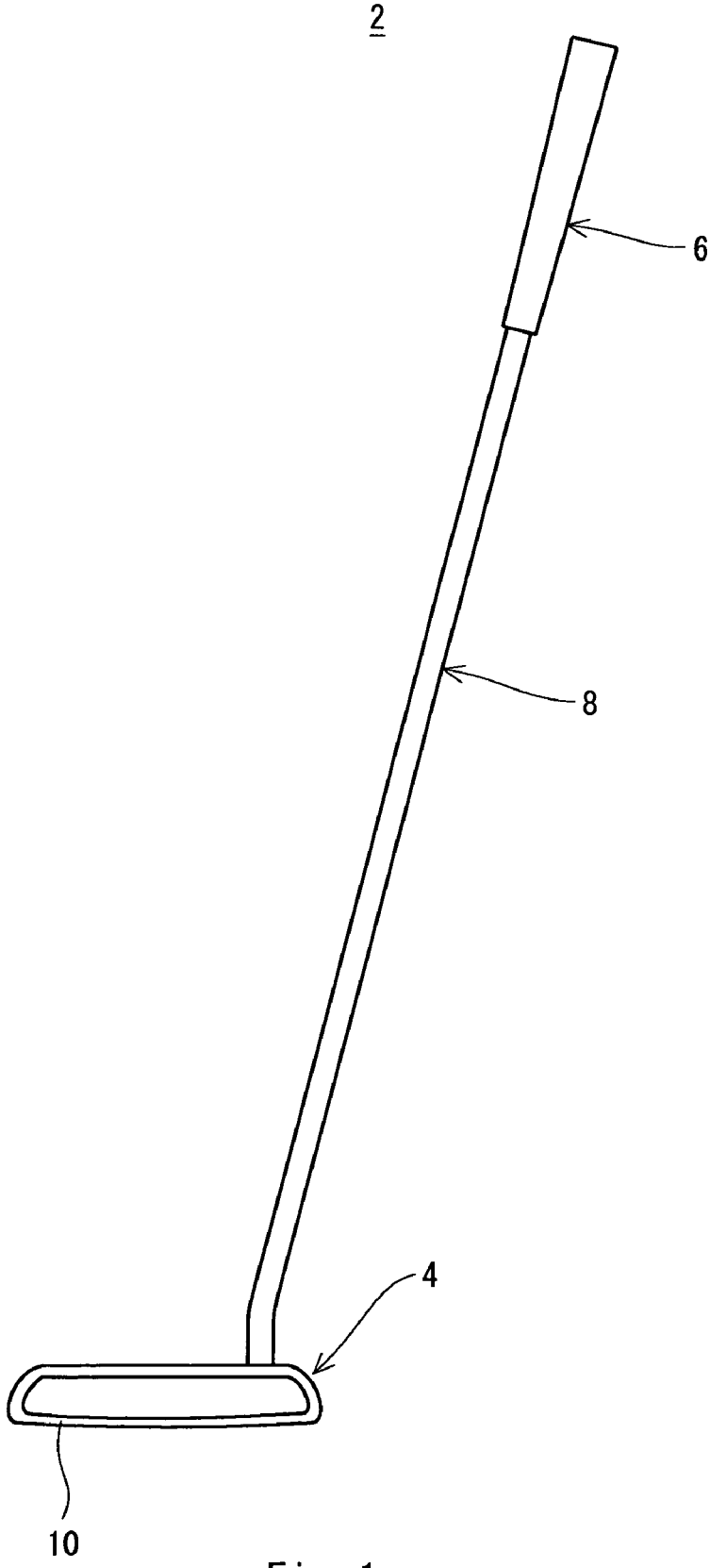
FIG. 1 is a general view showing a golf putter according to an embodiment of the present invention.

As shown in FIG. 1, a golf putter 2 has a head 4, a grip 6 and a shaft 8. The head 4 is attached to one of ends of the shaft 8. The grip 6 is attached to the other end of the shaft 8.

The vicinity of a tip portion of the shaft 8 is bent. By the bending, a lie angle and a real loft angle of the golf putter 2 are regulated properly.

Figure 2:
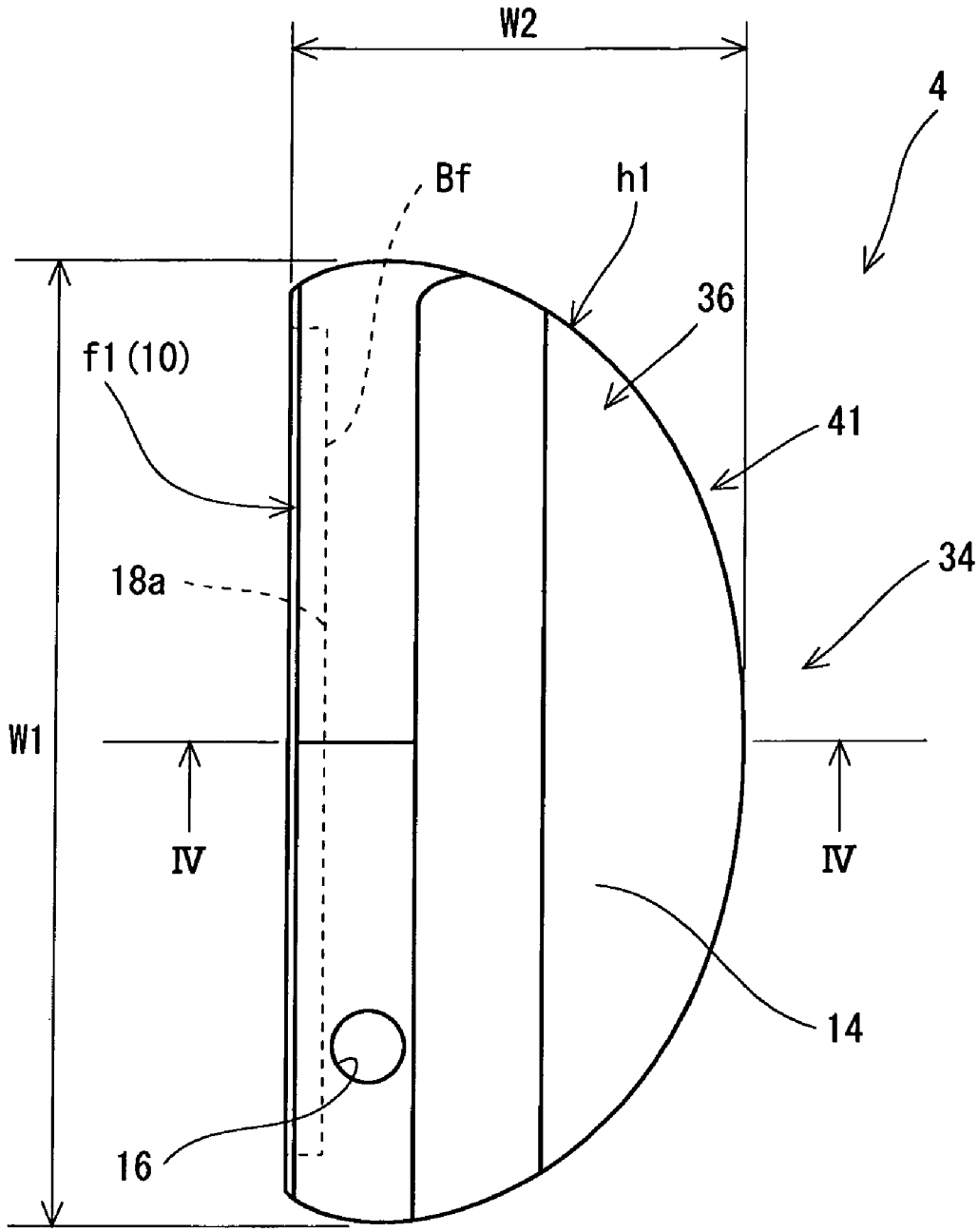
FIG. 2 is a view showing a head for the golf putter according to the embodiment of the present invention as seen from above.
Figure 3:
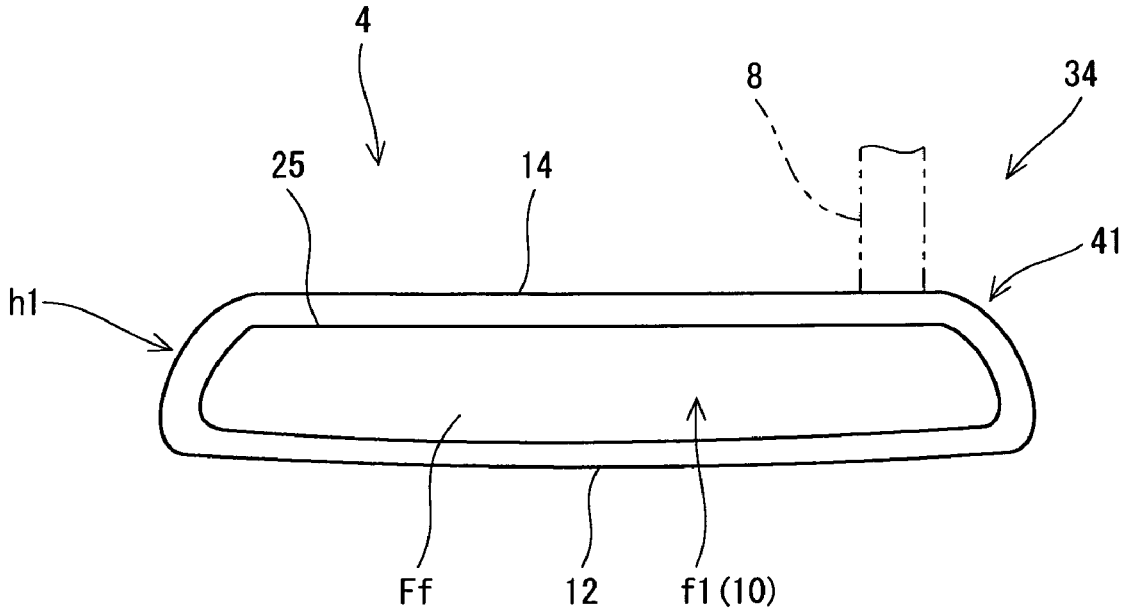
FIG. 3 is a view showing the head of FIG. 2 as seen from a face surface side.
Figure 4:
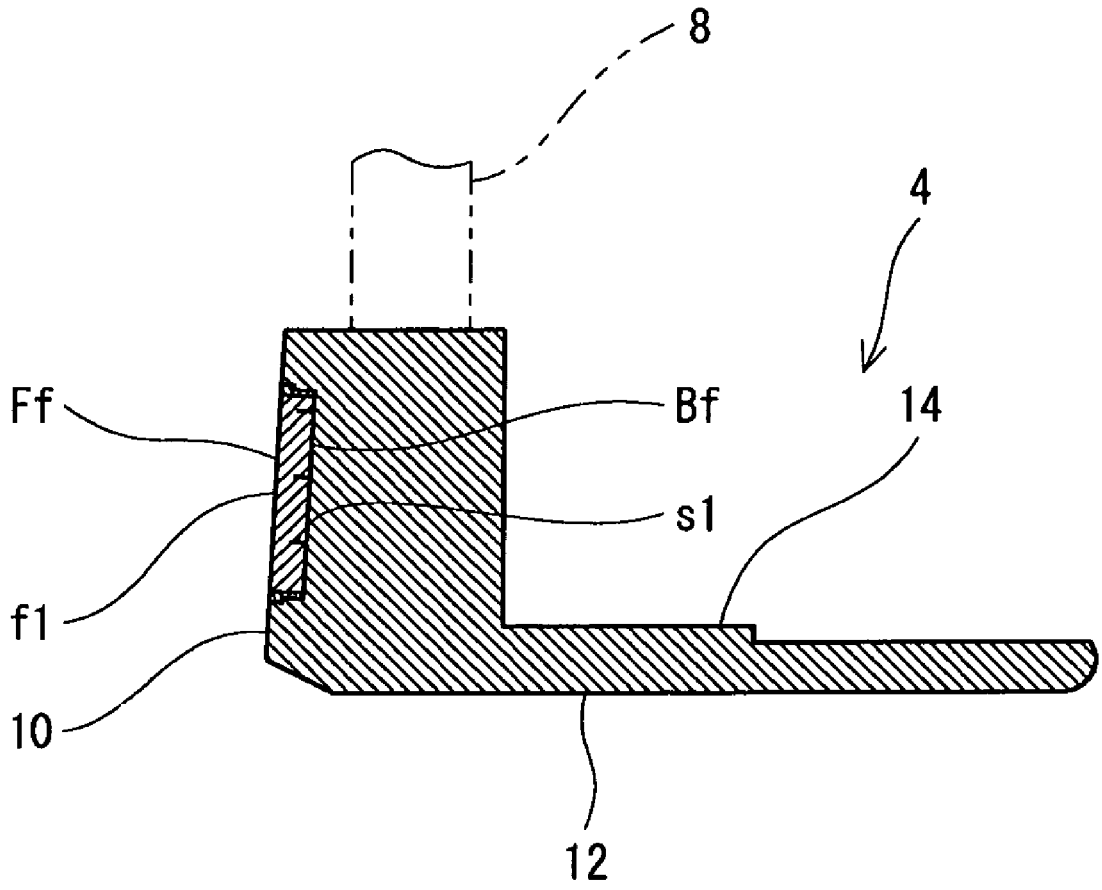
FIG. 4 is a sectional view taken along an IV-IV line in FIG. 2.
Figure 5:
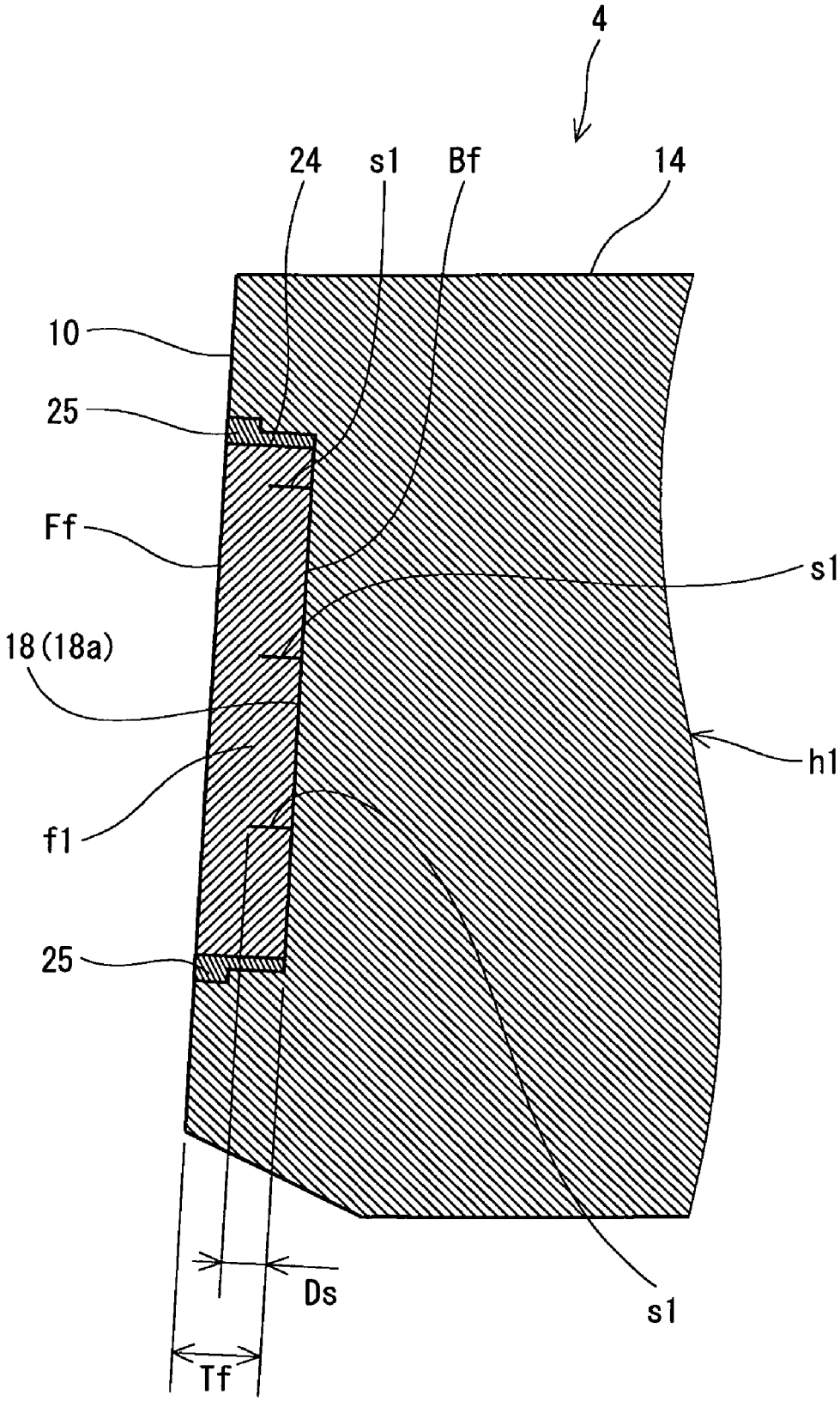
FIG. 5 is a sectional view showing an enlarged main part in FIG. 4.

FIG. 2 is a view showing the head 4 seen from above (a top side). FIG. 3 is a view showing the head 4 seen from a front part (a face surface side). FIG. 4 is a sectional view taken along an IV-IV line in FIG. 2 and FIG. 5 is a view showing an enlarged part of FIG. 4.

The head 4 has a face surface 10, a sole surface 12 and an upper surface 14. The face surface 10 constitutes a front surface of the head 4. The face surface 10 is a plane. In an impact, the face surface 10 and a golf ball come in contact with each other. The face surface 10 is a smoothly continuous surface. The face surface 10 may be a curved surface. Fine recesses and projections or grooves may be formed on the face surface 10 so as not to influence a rolling direction of the ball. Examples of the fine recesses and projections include milling marks formed by milling.

The head 4 has a head body h1 and a face member f1. The head body h1 is formed of a metal. The face member f1 is formed by an elastic material.

As shown in FIG. 2, a shaft hole 16 is provided on the head body h1. The tip portion of the shaft 8 is inserted in and bonded to the shaft hole 16.

The face member f1 is a plate-shaped member. As shown in FIG. 5, a recess portion 18 for disposing the face member f1 is provided on the head body h1. The face member f1 is accommodated in the recess portion 18. A depth of the recess portion 18 is substantially identical to a thickness Tf of the face member f1 (see FIG. 5). A contour shape of the recess portion 18 corresponds to a contour shape of the face member f1.

As shown in FIG. 5, the face member f1 has a front surface Ff and a back surface Bf. Furthermore, the face member f1 has a side surface 24. The front surface Ff constitutes a part of the face surface 10. The front surface Ff constitutes a central part of the face surface 10. A peripheral edge portion of the face surface 10 is constituted by the head body h1. A bottom surface 18*a* of the recess portion 18 and the back surface Bf are bonded to each other with a double-stick tape. In FIGS. 4 and 5, a section of the double-stick tape is not shown.

A coating material 25 is provided between the side surface 24 and the head body h1. The coating material 25 contains an acrylic resin as a base material, for example. The coating material 25 is disposed over a whole periphery of the face member f1. The coating material 25 fills up a clearance between the face member f1 and the head body h1. The coating material 25 contributes to a reliable fixation of the face member f1 to the head body h1. Moreover, a contour line of the face member f1 is clearly recognized visually by the coating material 25. The coating material 25 is colored. By the coloring, a beauty of the golf putter 2 can be enhanced.

Figure 6:
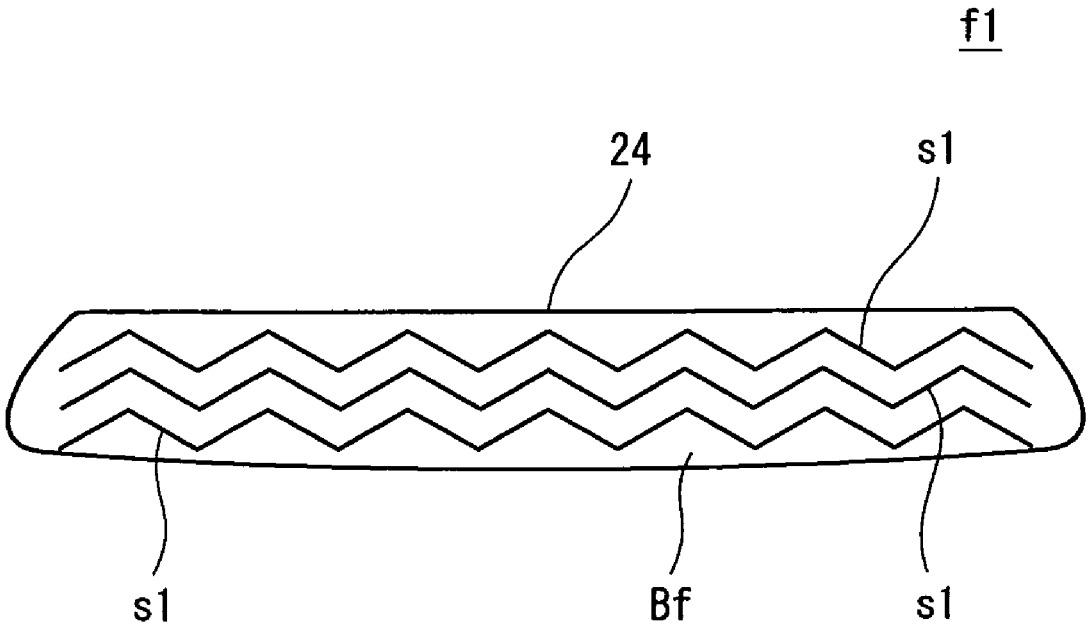
FIG. 6 is a plan view showing a face member according to the embodiment of the present invention as seen from-a back surface.

FIG. 6 is a plan view showing the face member f1 seen from a back surface side. As shown in FIGS. 5 and 6, a siping s1 is provided on the back surface Bf. In the present embodiment, three sipings s1 are provided.

In the present invention, the "siping" conceptually includes a cut and a groove. The siping s1 according to the present embodiment is the cut. The siping s1 to be the cut has a width Ws of 0 mm. For this reason, in FIG. 5 and the like, the siping s1 is represented as a line. In the case in which the siping s1 is the groove, a width of the groove is the width Ws of the siping. The siping s1 to be the cut is not restricted to be manufactured through cutting. For example, the siping s1 to be the cut may be formed simultaneously with forming for the face member f1.

The siping s1 is provided on only the back surface Bf of the face member f1. The siping s1 is not provided on the front surface Ff. The siping s1 does not penetrate through the face member f1. More specifically, the siping s1 has a termination in a middle position in a vertical direction of the face member f1. In the finished head 4, the siping s1 is not visually recognized from an outside. The siping s1 is not provided on the front surface Ff so that a direction of the face is changed with difficulty in an impact and a hitting directivity can be excellent.

As shown in FIG. 6, the siping s1 is extended with bending. The siping s1 according to the present embodiment is bent. In the present embodiment, the siping s1 is bent zigzag. The siping s1 is extended in a toe-heel direction with a vertical reciprocation. The adjacent sipings s1 are parallel with each other.

By the presence of the siping s1, it is possible to obtain a feeling of soft hitting. Accordingly, it is possible to obtain the feeling of soft hitting without excessively softening the material of the face member f1. By the siping s1, a control of a rolling distance and the feeling of soft hitting can be consistent with each other. Furthermore, a vibration absorbing property can be enhanced by the siping s1.

In addition, the siping s1 is bent. Therefore, it has been found that the control property of the rolling distance and the hitting directivity can be enhanced. The reason why the effect is produced is not clear. However, the following can be presumed to be the reason. The deformation of the face member f1 is equalized in an impact by bent siping or the deformation is prevented from being excessively increased by bent siping.

In FIG. 5, a double arrow Ds indicates a depth of the siping s1. In the case in which the depth Ds of the siping s1 is excessively small, a feeling of soft hitting is obtained with difficulty. In the case in which the thickness Tf of the face member f1 is excessively great, moreover, control properties of a rolling distance and a hitting direction tend to be reduced. From these viewpoints, a ratio (Ds/Tf) is preferably equal to or higher than 0.1, is more preferably equal to or higher than 0.2 and is further preferably equal to or higher than 0.3. In the case in which the depth Ds of the siping s1 is excessively great, the control property of the rolling distance and a hitting directivity tend to be reduced. In the case in which the thickness Tf of the face member f1 is excessively small, furthermore, the feeling of soft hitting is obtained with difficulty. From these viewpoints, the ratio (Ds/Tf) is preferably equal to or smaller than 0.9, is more preferably equal to or smaller than 0.8, and is further preferably equal to or smaller than 0.6.

In the case in which the width Ws of the siping s1 is excessively great, a portion divided by the siping s1 is apt to fall down. In the case in which the width Ws of the siping s1 is excessively great, the control properties of the rolling distance and the hitting direction tend to be reduced. From this viewpoint, the width Ws of the siping s1 is preferably equal to or smaller than 1.0 mm, is more preferably equal to or smaller than 0.5 mm, and is further preferably equal to or smaller than 0.3 mm. A lower limit of the width Ws of the siping s1 is 0.0 mm. In other words, the siping may be a cut as described above.

A total length M (mm) of the siping s1 is a total of lengths of all the sipings s1 provided on the face member f1. The total length M is measured in a direction of extension of the siping s1. In the case in which the siping s1 is bent, the total length M is measured along the bent siping s1. The total length M is a total of the lengths of the sipings s1 as seen on a plane in FIG. 6. An outer peripheral length P (mm) of the face member f1 is a length of a contour line of the face member f1 as seen on a plane in FIG. 6. In order to soften the feeling of hitting, a ratio (M/P) is preferably equal to or higher than 1, is more preferably equal to or higher than 1.2, and is further preferably equal to or higher than 1.5. In order to enhance the control property of the rolling distance and the hitting directivity, the ratio (M/P) is preferably equal to or lower than 5, is more preferably equal to or lower than 4, and is further preferably equal to or lower than 2.

In order to suppress the excessive deformation of the face member f1 and to enhance the hitting directivity, a material hardness (Shore D) of the face member f1 is preferably equal to or greater than 50, is more preferably equal to or greater than 55, and is further preferably equal to or greater than 60. In order to obtain the feeling of soft hitting, the material hardness (Shore D) of the face member f1 is preferably equal to or smaller than 80, is more preferably equal to or smaller than 75, and is further preferably equal to or smaller than 70.

The material hardness of the face member f1 is measured in accordance with the rules of "ASTM-D 2240-68". For the measurement, there is used an automatic rubber hardness measuring machine having a Shore D type hardness meter attached thereto (trade name "P1" manufactured by KOBUNSHI KEIKI CO., LTD.). For the measurement, there is used a sheet fabricated by the same material as the face member f1 and having a thickness of approximately 2 mm. Prior to the measurement, the sheet is stored for two weeks at a temperature of 23° C. In the measurement, three sheets are superposed on each other.

Figure 7:
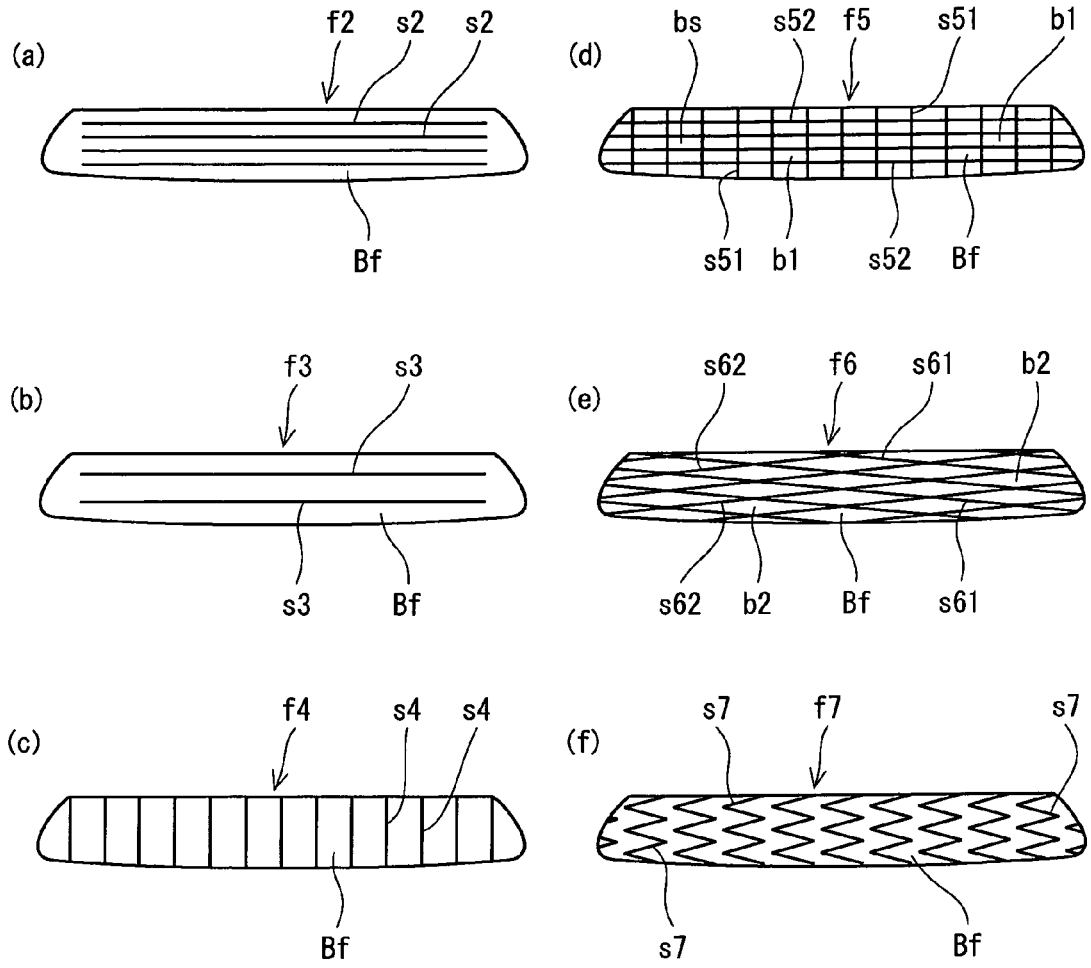
FIG. 7 is a plan view showing a face member according to a variant of the present invention as seen from a back surface.

FIG. 7 is a plan view showing a face member according to a variant as seen from the back surface Bf side. FIG. 7 illustrates six types of variants.

In a face member f2 shown in FIG. 7(*a*), a siping s2 is extended in a toe-heel direction. Four sipings s2 are provided. All of the sipings s2 are parallel with each other. A plurality of sipings s2 is disposed at a regular interval. None of the sipings s2 set edges of the face member f2 as both ends. More specifically, the both ends of the siping s2 do not reach the edges of the face member f2.

In a face member f3 shown in FIG. 7(*b*), a siping s3 is extended in the toe-heel direction. Two sipings s3 are provided. The two sipings s3 are parallel with each other. None of the sipings s3 set edges of the face member f3 as both ends.

In a face member f4 shown in FIG. 7(*c*), a siping s4 is extended in a vertical direction. Thirteen sipings s4 are provided. All of the sipings s4 are parallel with each other. All of the sipings s4 set edges of the face member f4 as both ends.

A face member f5 shown in FIG. 7(*d*) is provided with a siping s51 extended in the vertical direction and a siping s52 extended in the toe-heel direction. All of the sipings s51 are parallel with each other. The sipings s51 are disposed at a regular interval. All of the sipings s51 set edges of the face member f5 as both ends. All of the sipings s52 are parallel with each other. The sipings s52 are disposed at a regular interval. All of the sipings s52 set the edges of the face member f5 as both ends. The sipings s51 and s52 cross each other. By the sipings s51 and s52, mesh-like sipings are formed. A block b1 having a circumference (four sides) surrounded with the sipings is formed by two sides formed by the sipings s51 and two sides formed by the sipings s52. The block b1 takes a rectangular shape. The block b1 is a rectangle. The block b1 has an equal size.

A face member f6 shown in FIG. 7(*e*) is provided with a siping s61 extended in a leftward and upward direction as seen on a plane and a siping s62 extended in a rightward and upward direction as seen on a plane. The siping s61 is inclined to an upper side toward the heel side. The siping s62 is inclined to an upper side toward the toe side. All of the sipings s61 are parallel with each other. The sipings s61 are disposed at a regular interval. All of the sipings s61 set edges of the face member f6 as both ends. All of the sipings s62 are parallel with each other. The sipings s62 are disposed at a regular interval. All of the sipings s62 set the edges of the face member f6 as both ends. The sipings s61 and s62 cross each other. By the sipings s61 and s62, mesh-like sipings are formed. A block b2 having a circumference surrounded with the sipings is formed by two sides formed by the sipings s61 and two sides formed by the sipings s62. The block b2 takes a rectangular shape. The block b2 is a parallelogram. The block b2 has an equal size.

A face member f7 shown in FIG. 7(*f*) is provided with a zigzag siping s7. The siping s7 is extended in a vertical direction with a reciprocation in the toe-heel direction. The sipings s7 are disposed at a regular interval. All of the sipings s7 set edges of the face member f7 as both ends.

A specification of the siping is not restricted. It is possible to employ sipings taking all configurations other than the sipings s1 to s7.

A method of forming the siping is not restricted. A siping having a width Ws of 0 mm can be formed by making a cut by means of a cutter or the like, for example. A siping having a width Ws exceeding 0 mm can be formed simultaneously with forming for the face member f1, for example. In this case, a mold for the face member f1 is provided with a projecting portion for forming the siping.

A material of the head body is a metal. Examples of the material of the head body include stainless steel, an aluminum alloy, soft iron (mild steel), brass, pure titanium and a titanium alloy. The head body may be fabricated by a combination of materials. The head body may be fabricated by a combination of members. The head body may be formed of only a metal or may be formed by a combination of a metal and a non-metal. In case of the head body h1 formed by the combination of a metal and a non-metal, it is preferable that a metal portion of the head body h1 should include a face member attaching portion and a shaft attaching portion in order to produce the effect of the face member more obviously. Examples of the face member attaching portion include the recess portion 18. Examples of the shaft attaching portion include a shaft hole of a hosel and an overhosel in addition to the shaft hole 16.

A method of manufacturing the head body is not restricted. Examples of the method of manufacturing the head body include casting, forging and shaving (cutting). It is also possible to use a head body obtained by bonding a plurality of members. Examples of the bonding include welding, press-in, adhesion using an adhesive agent, and the like.

A material of the face member is set to be an elastic material. Examples of the elastic material include a resin and a rubber. Examples of the resin include an ionomer resin, an urethane resin, polyurethane elastomer, polyester type elastomer, and the like. Examples of the polyurethane elastomer include thermoplastic elastomer having a hard segment and a soft segment. It is possible to suitably use the urethane resin which is processed comparatively easily and has a proper hardness. Examples of the rubber include a styrene-butadiene rubber and a butadiene rubber.

A method of bonding the head body to the face member is not restricted. Examples of the bonding include an adhesion using a double-stick tape, an adhesion using an adhesive agent, press-in, and the like. It is also possible to use the adhesion using a double-stick tape and the adhesive agent together. In the case in which the adhesive agent enters the siping, the effect obtained by providing the siping tends to be reduced. From this viewpoint, it is preferable that the adhesive agent should not be present in the siping. In respect of a productivity and a prevention of the adhesive agent from flowing into the siping, the adhesion using a double-stick tape is preferred.

In some cases in which an area of the front surface Ff is excessively small, a feeling of soft hitting is obtained with difficulty due to a shift of a hitting point or the like. From this viewpoint, the area of the front surface Ff is preferably equal to or larger than 8 $cm^2$, is more preferably equal to or larger than 9 $cm^2$, and is further preferably equal to or larger than 10 $cm^2$. In consideration of a size of the head 4, the area of the front surface Ff is preferably equal to or smaller than 20 $cm^2$ and is more preferably equal to or smaller than 18 $cm^2$.

In some cases in which an area of the back surface Bf is excessively small, the feeling of soft hitting is obtained with difficulty due to the shift of the hitting point or the like. From this viewpoint, the area of the back surface Bf is preferably equal to or larger than 8 $cm^2$, is more preferably equal to or larger than 9 $cm^2$, and is further preferably equal to or larger than 10 $cm^2$. In consideration of the size of the head 4, the area of the back surface Bf is preferably equal to or smaller than 20 $cm^2$ and is more preferably equal to or smaller than 18 $cm^2$.

In order to increase an area of the face member f1, a maximum width W1 in the toe-heel direction (see FIG. 2) is preferably equal to or greater than 80 mm, is more preferably equal to or greater than 85 mm, and is particularly preferably equal to or greater than 90 mm. In order to suppress a difficulty in taking a posture in addressing, the maximum width W1 in the toe-heel direction is preferably equal to or smaller than 130 mm, is more preferably equal to or smaller than 120 mm, and is particularly preferably equal to or smaller than 110 mm.

In order to increase a depth of a center of gravity, thereby suppressing a variation in a directivity in a missed hit and to enhance a stability of a stroke, a maximum width W2 in a face-back direction (see FIG. 2) is preferably equal to or greater than 20 mm, is more preferably equal to or greater than 30 mm, and is particularly preferably equal to or greater than 40 mm. In order to suppress an excessive increase in a weight of the head, the maximum width W2 in the face-back direction is preferably equal to or smaller than 120 mm, is more preferably equal to or smaller than 110 mm, and is particularly preferably equal to or smaller than 100 mm.

In order to prevent a club balance from being excessively reduced, thereby stabilizing a swing, the weight of the head 4 is preferably equal to or greater than 300 g, is more preferably equal to or greater than 315 g, and is particularly preferably equal to or greater than 330 g. In order to prevent the club balance from being excessively increased, thereby giving a swing easily, the weight of the head 4 is preferably equal to or smaller than 400 g, is more preferably equal to or smaller than 385 g, and is particularly preferably equal to or smaller than 370 g.

EXAMPLES

Although the effects of the present invention will be apparent from examples, the present invention should not be construed to be restrictive based on description of the examples.

Example 1

A golf putter "MI-707" manufactured by SRI Sports Co., Ltd. was used and a face member of the putter was replaced with the face member according to the present invention so that a putter according to an example 1 was obtained. A head body of the "MI-707" was fabricated by lost-wax precision casting and a material of the head body is SUS304. The face member according to the example 1 was manufactured by injection molding. A material of the face member was set to be thermoplastic polyurethane. A cut was formed on a back surface of the face member by means of a knife so that a siping having a width Ws of 0 mm was formed. A shape of the siping is shown in FIG. 7(*a*). The face member was bonded to a recess portion provided on a face surface of the head body. The bonding was carried out with a double-stick tape. #5000 formed by NITTO DENKO CORPORATION was used for the double-stick tape. A clearance between a side surface of the face member and the head body was filled up with a coating material. Thus, the golf putter according to the example 1 was obtained. A specification and a result of an evaluation in the example 1 are shown in the following Table 1.

Examples 2 to 5

A golf putter according to each of examples 2 to 5 was obtained in the same manner as in the example 1 except that a depth Ds of a siping was set as shown in the following Table 1. Specifications and results of an evaluation in these examples are shown in the following Table 1.

Example 6

A golf putter according to an example 6 was obtained in the same manner as in the example 4 except that a shape of a siping was set as shown in FIG. 6. A specification and a result of an evaluation in this example are shown in the following Table 1.

Examples 7 to 9

A golf putter according to each of examples 7 to 9 was obtained in the same manner as in the example 3 except that a width Ws of a siping was set as shown in the following Table 1. Specifications and results of an evaluation in these examples are shown in the following Table 1.

Comparative Example 1

A golf putter according to a comparative example 1 was obtained in the same manner as in the example 1 except that a siping was not provided. A specification and a result of an evaluation in this example are shown in the following Table 1.

Comparative Example 2

A golf putter according to a comparative example 2 was obtained in the same manner as in the comparative example 1 except that a material hardness (Shore D) of a face member was set to be 30. A specification and a result of an evaluation in this example are shown in the following Table 1.

Comparative Example 3

A golf putter according to a comparative example 3 was obtained in the same manner as in the example 1 except that a cut was penetrated and a siping penetrates from a front surface of a face member to a back surface thereof. A specification and a result of an evaluation in this example are shown in the following Table 1.

An evaluating method is as follows.

[Evaluation of Feeling of Hitting]

Putting was actually carried out by using "Z-UR" (trade name) manufactured by SRI Sports Co., Ltd. and put on the market. Ten golf players took a test. The golf player carries out five putting operations every club to aim at a cup placed six meters away. Each of the golf players evaluated the feeling of hitting in five grades based on the following criteria. The evaluation was carried out with the comparative example 1 set to be three-marks.

Five marks . . . very soft

Four marks . . . soft

Three marks . . . normal (the marks in the comparative example 1)

Two marks . . . hard

One mark . . . very hard

A mean value of the ten golf players is shown in the following Table 1.

[Longitudinal Shift Index Z1]

In the test for the evaluation of the feeling of hitting, a distance between a position in which a ball stops and a cup was measured. The distance was measured along a straight line L connecting a launch (hitting) position of the ball and the cup. For each club, a mean value of all of hitting operations (50 hitting operations) was calculated. The mean value was indexed with the comparative example 1 set to be 1.0 so that a longitudinal shift index Z1 was obtained. A result of an evaluation for the longitudinal shift index Z1 is shown in the following Table 1. It is indicated that a control property of a rolling distance is deteriorated when the longitudinal shift index Z1 is increased.

[Transverse Shift Index Z2]

In the test for the evaluation of the feeling of hitting, the shortest distance between the straight line L and a position in which a ball stops was measured. For each club, a mean value of all of hitting operations (50 hitting operations) was calculated. The mean value was indexed with the comparative example 1 set to be 1.0 so that a transverse shift index Z2 was obtained. A result of an evaluation for the transverse shift index Z2 is shown in the following Table 1. It is indicated that a control property of a direction is deteriorated when the transverse shift index Z2 is increased.

TABLE 1

Specification and Result of Evaluation in Example and Comparative Example

| | Comparative Example 1 | Comparative Example 2 | Example 1 | Example 2 | Example 3 | Example 4 | Example 5 | Comparative Example 3 | Example 6 | Example 7 | Example 8 | Example 9 |
|---|---|---|---|---|---|---|---|---|---|---|---|---|
| View showing Shape of Siping | No Siping | No Siping | FIG. 7(a) | FIG. 7(a) | FIG. 7(a) | FIG. 7(a) | FIG. 7(a) | FIG. 7(a) (penetrate) | FIG. 6 | FIG. 7(a) | FIG. 7(a) | FIG. 7(a) |
| Hardness of Face Member (Shore D) | 60 | 30 | 60 | 60 | 60 | 60 | 60 | 60 | 60 | 60 | 60 | 60 |
| Width of Siping Ws (mm) | — | — | 0 | 0 | 0 | 0 | 0 | 0 | 0 | 0.3 | 0.5 | 1 |
| Depth of Siping Ds(mm) | — | — | 1 | 1.5 | 2 | 3 | 4 | 5 | 3 | 2 | 2 | 2 |
| Thickness of Face Member Tf (mm) | 5 | 5 | 5 | 5 | 5 | 5 | 5 | 5 | 5 | 5 | 5 | 5 |
| Total Length of Siping M (mm) | — | — | 280 | 280 | 280 | 280 | 280 | 280 | 280 | 280 | 280 | 280 |
| Outer Peripheral Length of Face Member P (mm) | 170 | 170 | 170 | 170 | 170 | 170 | 170 | 170 | 170 | 170 | 170 | 170 |
| Ratio (Ds/Tf) | — | — | 0.2 | 0.3 | 0.4 | 0.6 | 0.8 | 1 | 0.6 | 0.4 | 0.4 | 0.4 |
| Ratio (M/P) | — | — | 1.6 | 1.6 | 1.6 | 1.6 | 1.6 | 1.6 | 1.6 | 1.6 | 1.6 | 1.6 |
| Evaluation for Feeling of Hitting | 3.0 | 5.0 | 3.2 | 3.6 | 3.7 | 4.0 | 4.0 | 4.4 | 3.9 | 3.7 | 3.9 | 4.1 |
| Longitudinal Shift Index Z1 | 1.0 | 1.8 | 1.1 | 0.9 | 1.0 | 1.1 | 1.2 | 1.2 | 1.0 | 0.9 | 1.1 | 1.2 |
| Transverse Shift Index Z2 | 1.0 | 1.1 | 1.0 | 0.9 | 1.0 | 1.2 | 1.4 | 1.7 | 1.1 | 1.1 | 1.3 | 1.5 |
| Z1 + Z2 | 2.0 | 2.9 | 2.1 | 1.8 | 2.0 | 2.3 | 2.6 | 2.9 | 2.1 | 2.0 | 2.4 | 2.7 |

By a comparison of the examples with the comparative examples, it is indicated that the feeling of hitting is enhanced by the siping. In the examples 1 to 5, the feeling of hitting is enhanced when a depth of the siping is increased. In the example 5, a ratio (Ds/Tf) is slightly high, that is, 0.8. Therefore, the transverse shift index Z2 is slightly great. From the results of the examples 4 and 6, it is indicated that the transverse shift index Z2 is improved by bending the siping. According to the results of the examples 7, 8 and 9, the transverse shift index Z2 is increased when the width Ws of the siping is increased. In the comparative example 2, the feeling of hitting is enhanced because the hardness of the face member is small, and the longitudinal shift index Z1 is increased. In the comparative example 3, the transverse shift index Z2 is increased because the siping penetrates.

As shown in the Table 1, the results of the evaluation in the examples are more excellent than the results of the evaluation in the comparative examples. From the results of the evaluation, the advantage of the present invention is apparent.

The above description is only illustrative and various changes can be made without departing from the scope of the present invention.

What is claimed is:

1. A head for a golf putter comprising a head body formed of a metal and a face member formed of an elastic material, wherein a front surface of the face member constitutes at least a part of a face surface, a siping is provided on a back surface of the face member, the siping is not provided on the front surface of the face member, and a width Ws of the siping is equal to or smaller than 1.0 mm.

2. A head for a golf putter according to claim 1, wherein the siping has a width Ws of 0 mm.

3. A head for a golf putter according to claim 1, wherein the face member is bonded to the head body using a double-stick tape.

4. A head for a golf putter comprising a head body formed of a metal and a face member formed of an elastic material, wherein a front surface of the face member constitutes at least a part of a face surface, a siping is provided on a back surface of the face member, the siping is not provided on the front surface of the face member, and a ratio (Ds/Tf) of a depth Ds of the siping to a thickness Tf of the face member is equal to or higher than 0.2 and is equal to or lower than 0.8.

5. A golf putter comprising a head for a golf putter, a shaft and a grip, wherein the head has a head body formed of a metal and a face member formed of an elastic material, a front surface of the face member constitutes at least a part of a face surface, a back surface of the face member is provided with a siping, the front surface of the face member is not provided with the siping, and a width Ws of the siping is equal to or smaller than 1.0 mm.

6. A head for a golf putter comprising a head body formed of a metal and a face member having an outer peripheral length P formed of an elastic material, wherein a front surface of the face member constitutes at least a part of a face surface, a siping is provided on a back surface of the face member, the siping is not provided on the front surface of the face member, the siping has a total length M including the lengths of all siping present, and a ratio M/P is equal to or higher than 1.

* * * * *